United States Patent [19]

Holz et al.

[11] 4,421,481

[45] Dec. 20, 1983

[54] FURNACE FOR HEATING SLABS, BILLETS, ROUGH CASTINGS AND THE LIKE

[75] Inventors: Peter Holz, Essen; Heinrich Patalon, Bochum; Edgar Hartkopf, Mülheim, all of Fed. Rep. of Germany

[73] Assignee: Didier Engineering GmbH, Essen, Fed. Rep. of Germany

[21] Appl. No.: 331,816

[22] Filed: Dec. 17, 1981

[30] Foreign Application Priority Data

Jan. 16, 1981 [DE] Fed. Rep. of Germany ..... 3101230
Aug. 17, 1981 [DE] Fed. Rep. of Germany ..... 3132373

[51] Int. Cl.[3] ..... F27D 3/00; F27B 9/26

[52] U.S. Cl. ..... 432/239; 414/154; 432/126; 432/137; 432/241

[58] Field of Search ..... 432/126, 137, 239, 241; 414/154; 105/451

[56] References Cited

U.S. PATENT DOCUMENTS

| | | | |
|---|---|---|---|
| 1,127,224 | 2/1915 | Freihofer | 414/154 |
| 1,638,988 | 8/1927 | Dressler | 432/137 |
| 1,968,775 | 7/1934 | Robertson | 432/241 |
| 3,119,606 | 1/1964 | Suydam et al. | 414/154 |
| 3,137,485 | 6/1964 | Johnson et al. | 432/126 |
| 3,721,226 | 3/1973 | Childree et al. | 105/451 |

*Primary Examiner*—John J. Camby

*Attorney, Agent, or Firm*—Wenderoth, Lind & Ponack

[57] ABSTRACT

A furnace for heating all sides of products such as metal slabs, billets, rough castings and the like includes a furnace chamber having a charging end and a discharging end. A plurality of carriages are positioned throughout the length of the furnace chamber to support products to be heated and are sequentially movable through the chamber from the charging end thereof to the discharging end thereof. Each carriage includes a support bench having extending upwardly therefrom support members to directly contact and support the products to be heated. A charging station is located adjacent the charging end of the furnace chamber for loading a product to be heated onto the carriage and introducing the thus loaded carriage into the furnace chamber, thereby displacing loaded carriages within the furnace chamber toward the discharging end and discharging a downstream-most loaded carriage from the discharging end of the furnace chamber. An unloading structure is located adjacent the discharging end for unloading a heated product from the carriage discharged from the discharging end. A return chamber extends from adjacent the unloading structure to the charging station to enable the unloaded carriage to be returned to the charging station. A heat insulation device within the return chamber reduces heat loss from the unloaded carriage while in the return chamber.

15 Claims, 7 Drawing Figures

FURNACE FOR HEATING SLABS, BILLETS, ROUGH CASTINGS AND THE LIKE

BACKGROUND OF THE INVENTION

The present invention relates to a furnace for the heating of products such as slabs, billets, rough castings and the like. More particularly, the present invention relates to such a furnace having a furnace chamber including a support arrangement for supporting the products in a manner to achieve two-sided heating of the products, i.e. heating of both opposite major surfaces of the products.

Furnaces of this type are used in rolling mills and forges for the purpose of heating rough metal castings to a desired temperature for processing, i.e. for rolling or forging, whereby the need for heating of the product from all sides thereof will be apparent.

Known furnaces of this type are of the pusher or rocker bar construction. Within such a furnace, the products to be heated on opposite sides rest on water cooled support pipes. These support pipes however, due to their cooling system, considerably increase the energy demand of the furnace, since the coolant of the cooling system draws heat from the furnace. Additionally of course, the mere necessity of the provision of the cooling system is an operational disadvantage.

Furthermore, in this conventional type of furnace, considerable wear occurs during operation, in spite of cooling of the support pipes, since there is a continuous friction or forging between the products to be heated and the support pipes. This necessitates periodic repair of the support pipe system, with the undesirable necessity of periodically shutting down operation of the furnace. A further disadvantage of such known furnaces is that cooling shadows result on the products to be heated wherever the product directly rests on the cooling support pipes. This may cause qualitative shortcomings of the end products made from the material thus treated.

SUMMARY OF THE INVENTION

With the above discussion in mind, it is an object of the present invention to provide a furnace for heating all sides of products such as slabs, billets, rough castings and the like, whereby the above discussed and other prior art disadvantages are avoided.

It is a further object of the present invention to provide such a furnace in which the transportation of the products to be heated through the furnace is carried out in a manner such that wear on the furnace and the energy required for operation of the furnace are reduced.

These objects are achieved in accordance with the present invention by the provision of a furnace including a furnace chamber having a charging end and a discharging end. Support means are provided for supporting products to be heated within the chamber. The support means comprises a plurality of carriages positioned throughout the length of the furnace chamber for sequential movement therethrough from the charging end to the discharging end. Each carriage includes a support bench having extending upwardly therefrom support members which contact and support a product to be heated. A charging station is located adjacent the charging end of the furnace chamber for loading a product to be heated onto a carriage and introducing the thus loaded carriage into the furnace chamber. This displaces loaded carriages within the furnace chamber toward the discharging end and discharges a downstream-most loaded carriage from the discharging end of the furnace chamber. Unloading structure is located adjacent the discharging end for unloading a heated product from the carriage discharged from the discharging end. A return chamber is exterior or separate from the furnace chamber and extends from adjacent the unloading structure to the charging station to enable the carriage unloaded by the unloading structure to be returned to the charging station. A heat insulation device is within the return chamber to reduce heat loss from the unloaded carriage while the unloaded carriage is in the return chamber.

The furnace structure according to the present invention reduces the energy requirements for the furnace since the furnace carriages and other support structure are not cooled inside the furnace and therefore draw little heat from the furnace chamber. Furthermore, the carriages and other support structure lose only a slight amount of stored heat exterior of the furnace chamber. The products are more evenly heated, inasmuch as the products to be heated rest on support members which are not cooled. Between the points of contact between the products and the support members, the products are exposed to the heat within the furnace chamber.

Wear on the furnace elements is reduced because the products to be heated do not move with respect to the support structure, but rather are transported through the furnace while resting directly on the support structure without relative movement therebetween.

It is an additional advantage of the invention that the carriages and support structures may be individually exchanged or replaced for repair outside of the furnace chamber, so that their repair does not result in the need for shutting down of the furnace.

In accordance with a further feature of the present invention the support benches and support members are formed of refractory fire-proof material, and the surfaces thereof which face the furnace chamber and are exposed to the heat thereof, except for the contact surfaces of the support member to be directly in contact with the products to be heated, are covered with a heat resistant fiber mat material. The contact surfaces are free of the fiber mat material and directly contact the products to be heated.

In accordance with a further feature of the present invention the heat insulation device within the return chamber may comprise at least one heat insulation hood which may be mounted to be movable to a position to cover at least portions of the support members. Such hood may be capable of being heated.

The furnace chamber may have rails therein, with the carriages being guided for movement through the furnace chamber by the rails. Also, the return chamber may have therein rails for guiding movement of the unloaded carriage. The charging station may include a first elevator for moving the unloaded carriage between the return chamber and the furnace chamber, and a second elevator may be positioned adjacent the unloading structure for moving the unloaded carriage from the discharging end of the furnace chamber to the return chamber. The first and second elevators may have rail extensions positioned to align with the rails in the furnace and return chambers.

The lateral walls of the furnace chamber may include longitudinally extending profiled channels. Each carriage extends across substantially the entire width of the furnace chamber, and such carriages may have depending therefrom aprons which contact surfaces or ledges of the channels. Adjacent of the support benches preferably are in abutting contact within the furnace chamber. The aprons and the carriages may define a separate passage through a lower portion of the furnace chamber. The charging and discharging ends of the furnace chamber may have openable furnace doors. Such doors are dimensioned such that, when closed, they do not cover the passage in the lower portion of the furnace chamber.

Preferably, the support members extend longitudinally in the direction of movement of the carriages through the furnace chamber, and the charging station includes a grate formed of elongated finger-like projections extending in such direction, the projections being positioned to fit between adjacent of the support members. The height of the projections is less than the height of the support members, and the charging station further includes an elevator for lifting the unloaded carriage from the return chamber toward the grate, whereby a product to be heated which is supported on the projections is lifted from the projections by the support members. The charging station further may include a push rod charger for advancing the loaded carriage into the furnace chamber, the push rod charger being supported on a protected bearing in one of the projections of the grate.

In an alternative arrangement, each projection may have mounted there above a roller having a rotational axis extending in the direction of movement of the carriages through the furnace chamber, the distance between adjacent of the rollers being at least equal to the distance between adjacent support members. The combined height of each projection and respective roller is less than the height of the support members. The charging station may include an elevator for lifting the unloaded carriage from the return chamber toward the grate, whereby a product to be heated which is supported on the rollers is lifted from the rollers by the support members. The rollers may be motor driven to rotate about the axes thereof, whereby the rollers would be capable of loading products to be heated onto the grate, whereafter the products would be taken over by a carriage and the thus loaded carriage would then be introduced into the furnace chamber. In this manner, not only the capital investment but also the space required for loading and unloading is reduced.

The various loading and unloading arrangements of the present invention may be provided at the charging end and at the discharging end of the furnace, or at only one end thereof. An advantage of all embodiments of the present invention is that the product to be heated is not forced to slide with friction against any of the elements of the invention.

BRIEF DESCRIPTION OF THE DRAWINGS

Other objects, features and advantages of the present invention will be apparent from the following detailed description of preferred embodiments thereof, taken with the accompanying drawings, wherein.

DETAILED DESCRIPTION OF THE INVENTION

Figure 1:
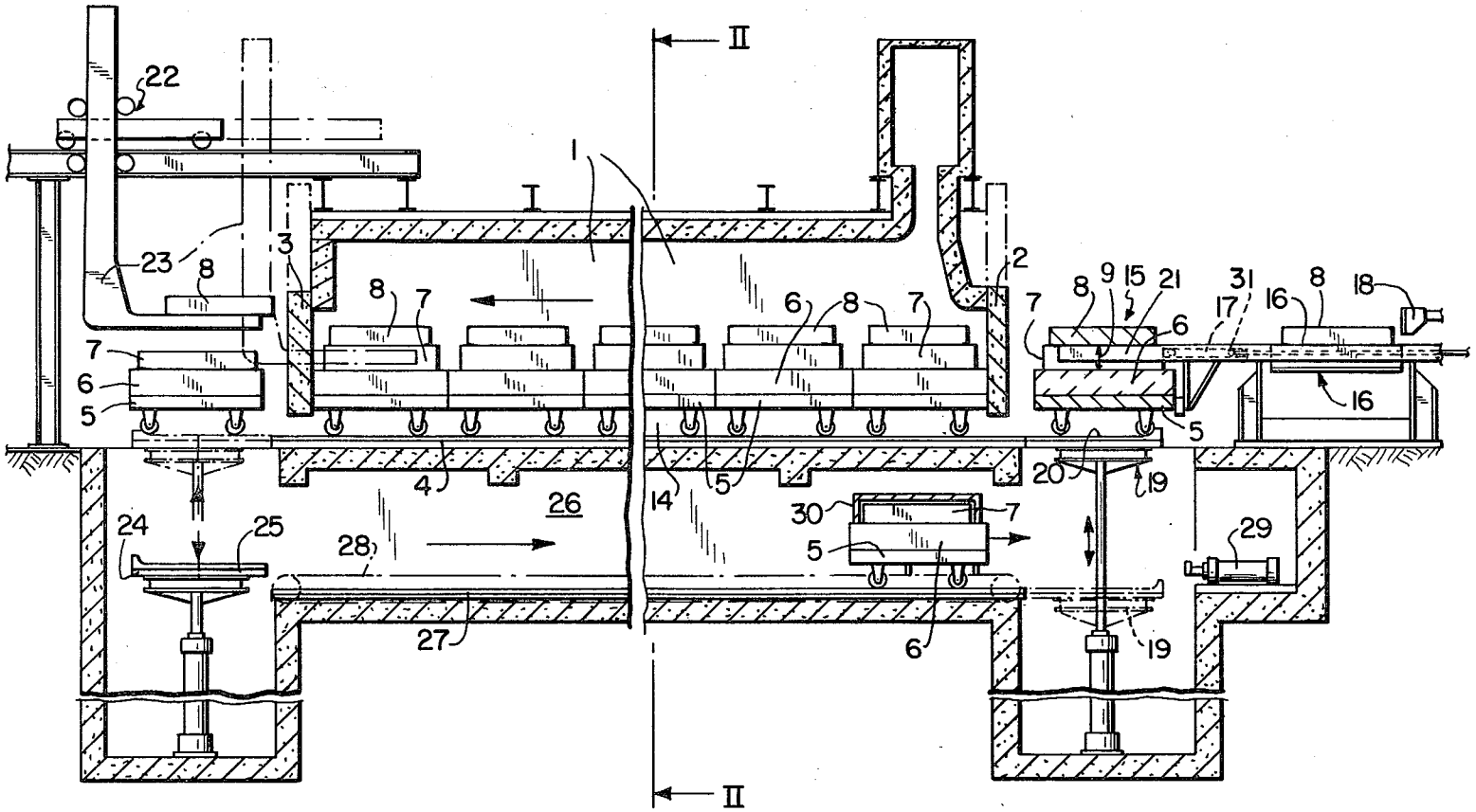
FIG. 1 is a schematic longitudinal section through a furnace according to one embodiment of the present invention.

With reference now to FIGS. 1 through 4, a first embodiment of the furnace of the present invention will be described. The furnace includes an elongated furnace chamber 1 having a charging end and a discharging end, with an openable furnace door 2 at the charging end and an openable furnace door 3 at the discharging end. Within the furnace chamber 1 there are provided longitudinally extending rails 4 which support for longitudinal movement throughout the length of the furnace chamber a plurality of support devices including furnace wagons or carriages 5 which adjoin each other and which extend throughout the entire length of the furnace chamber 1.

Figure 2:
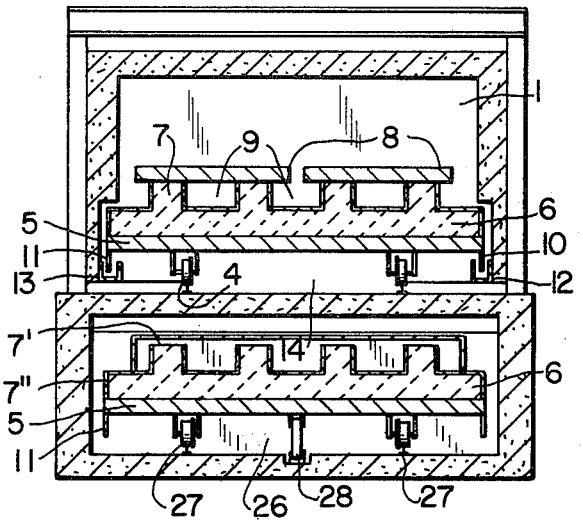
FIG. 2 is a transverse section taken along line II—II of FIG. 1.
Figure 3:
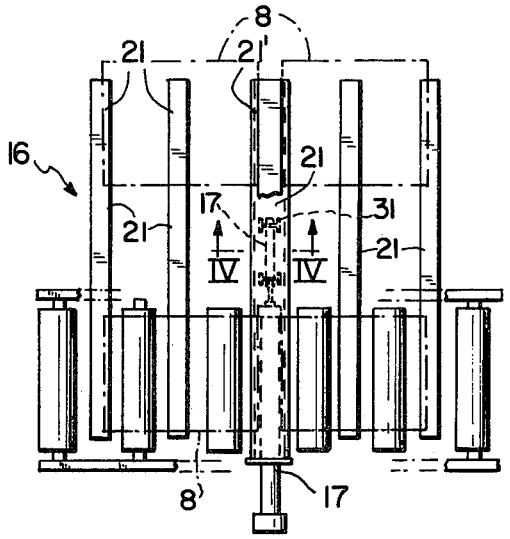
FIG. 3 is a partial top plan view of the loading structure of the arrangement of FIG. 1.
Figure 4:
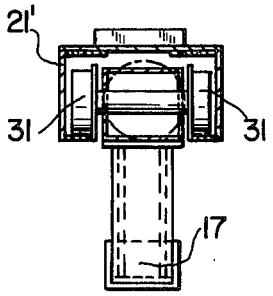
FIG. 4 is an enlarged section taken along line IV—IV in FIG. 3.

Each carriage 5 has thereon a deposit or support bench 6 having extending upwardly therefrom bearing or support members 7 which are elongated in the direction of movement of the carriages through the furnace chamber 1. Support benches 6 and respective support members 7 are formed as a refractory fire-proof material, and as seen in FIG. 2 the surfaces thereof which are exposed to the furnace chamber and which face the furnace chamber are covered with a heat resistant fiber mat material 7″. However, the upper surfaces 7′ of support member 7 which contact the products 8 to be heated are free of material 7″. The support members 7 are designed so that the products 8 to be heated rest securely on contact surfaces 7′, and such that free spaces or interstices 9 are provided between adjacent support members 7. Support members 7 of adjacent support benches 6 are spaced from each other longitudinally of the furnace chamber. These arrangements enable each product 8 to be heated on the lower side thereof.

The support benches extend transversely across the entire width of the furnace chamber, as particularly shown in FIG. 2. Lateral walls of the furnace chamber are provided with longitudinally extending recessed channels supporting U-shaped ledges 12, 13. The support benches 6 or carriages 5 have depending from lateral edges thereof aprons 10, 11 which contact ledges 12, 13 thereby providing a sliding seal during movement of the carriages through the furnace chamber. This sealing and the structure of the aprons and carriages create and define a separate passage area 14 beneath the carriages 5. Area 14 is not in immediate or direct communication with the furnace chamber 1. As is shown in FIG. 1, doors 2 and 3 are dimensioned such that when closed they leave passage area 14 open, whereby air may be circulated through passage area 14 from the exterior. This ensures that the rails 4 and carriages 5, and particularly the wheels and bearings thereof, are not exposed to the full heat of the furnace chamber. Located adjacent the charging end of the furnace chamber is a charging station 15 including a grate 16 formed of elongated finger-like projections 21 extending in the direction of movement of the carriages through the furnace chamber. The projections are dimensioned and positioned to fit in interstices 9 between adjacent support members 7. Located adjacent the discharging end of the furnace chamber is an unloading structure 22 including a grate 23 similar in construction to the grate 16 and formed of finger-like projections dimensioned and positioned to fit between adjacent support members. Unloading structure 22 is vertically movable, as shown in FIG. 1. Exterior of furnace chamber 1 and extending parallel thereto is an enclosed return chamber 26. Chamber 26 is located beneath furnace chamber 1 and is for the purpose of returning an unloaded carriage from the discharging end of the furnace chamber to the charging end thereof. Chamber 26 has therein rails 27 similar to rails 4 in furnace chamber 1. Furthermore, chamber 26 may be provided with means, such as chain 28, for moving an unloaded carriage within chamber 26. The charging station further includes a platform elevator 19 having thereon rail extensions 20. Located adjacent the discharging end of the furnace chamber is a further platform elevator 24 having rail extensions 25. Rail extensions 20 and 25 are adapted to align with rails 4 and 27.

Within return chamber 26 is at least one heat insulation hood 30 which can be raised and lowered and which can be superimposed over the support bench 6 of an unloaded carriage 5 within chamber 26. Hood 30 serves the purpose of reducing heat radiation from bench 6 during the time the carriage thereof remains in the chamber 26. Hood 30 is mounted to be raised and lowered if desired and may be heated, for example by gas heating means. By this arrangement, and due to the provision of heat resistant fiber mat material 7'', loss of heat from support bench 6 while it is within chamber 26 is substantially reduced.

Charging station 15 further includes a product pusher 18 for supplying a product 8 to be heated onto grate 16. The charging station 15 further includes a push rod charger 17, such as a tappet, held in a bearing by rollers 31 within a boxed-shaped profile 21' forming one projection 21 of grate 16. In this manner, the push rod charger and its bearing are protected from heat damage.

Although it is believed that the operation of this embodiment of the present invention will be apparent from the above description, such operation will now be briefly described.

Beginning with the furnace substantially as shown in FIG. 1, and with the furnace preheated and filled with furnace carriages 5, support benches 6 and support members 7 and products 8 being heated, the operational sequence is as follows.

At charging station 15, a product 8 to be heated is pushed by means of product pusher 18 onto the finger grate 16. Elevator 19 is in its lowered position shown in dashed lines in FIG. 1. Chain 28 moves an unloaded carriage 5 in chamber 26 onto rails 20 of platform 19. Positioning cylinder 29 positions the unloaded carriage on platform 19. Elevator 19 is then raised to lift carriage 5 toward grate 16. The vertical height of fingers 21 is less than the vertical height of support members 7. Thus, support members 7, upon raising of platform 19, slightly lift product 8 from grate 16.

Doors 2 and 3 are then opened and push rod charger 17 is actuated to push the carriage 5 on elevator 19 into the furnace chamber 1. This causes sequential movement of all of the carriages 5 within the chamber 1 towards the discharging end thereof. The downstream-most loaded carriage is discharged through the discharging end of the furnace onto rails 25 of elevator 24 which is in its raised position shown by the dashed lines in FIG. 1. Unloading structure 22 is then operated to lift the heated product 8 from the carriage which is discharged from the furnace chamber. Doors 2 and 3 are then closed. Elevator 24 is lowered to lower the unloaded carriage to the level of return chamber 26, and the unloaded carriage is moved, for example by chain 28, through the return chamber 26 to the position shown in FIG. 1. Heat insulation hood 30 is lowered to be superimposed on bench 6 and members 7. The unloaded carriage remains in this position, until it is required for the next product to be heated and introduced into the furnace chamber.

The bench 6 and members 7 cool down only very minimally between the time they leave the discharging end of the furnace chamber 1 and the time it is returned thereto, since during the majority of such time it is substantially protected by heat insulation hood 30. In this way, only a very slight amount of heat is removed from chamber 1, and the contact surfaces 7' are not allowed to be cooled when they contact product 8. Furthermore, transportation of the product 8 takes place without any substantial amount of friction with respect to the transport structure. Accordingly, wear of the support member 7 is only minor.

Figure 5:
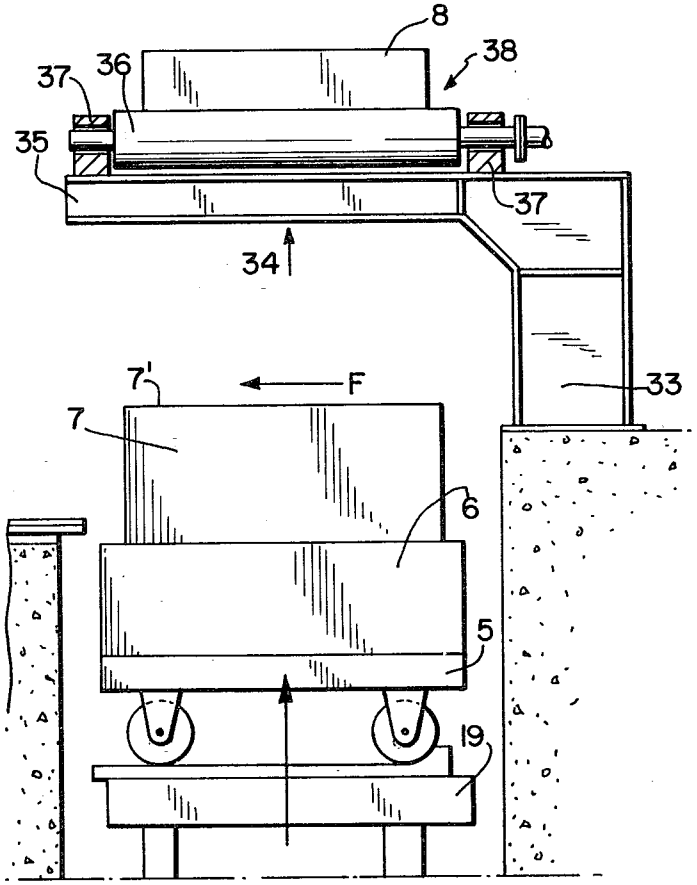
FIG. 5 is a schematic longitudinal section of a loading installation according to a second embodiment of the present invention.
Figure 6:
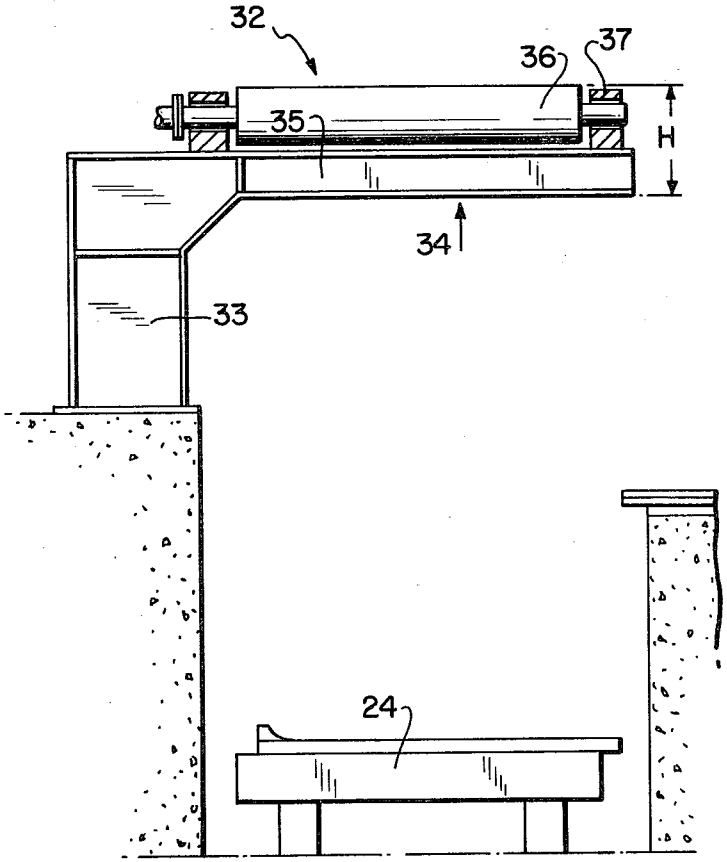
FIG. 6 is a view similar to FIG. 5 but of an unloading installation.
Figure 7:
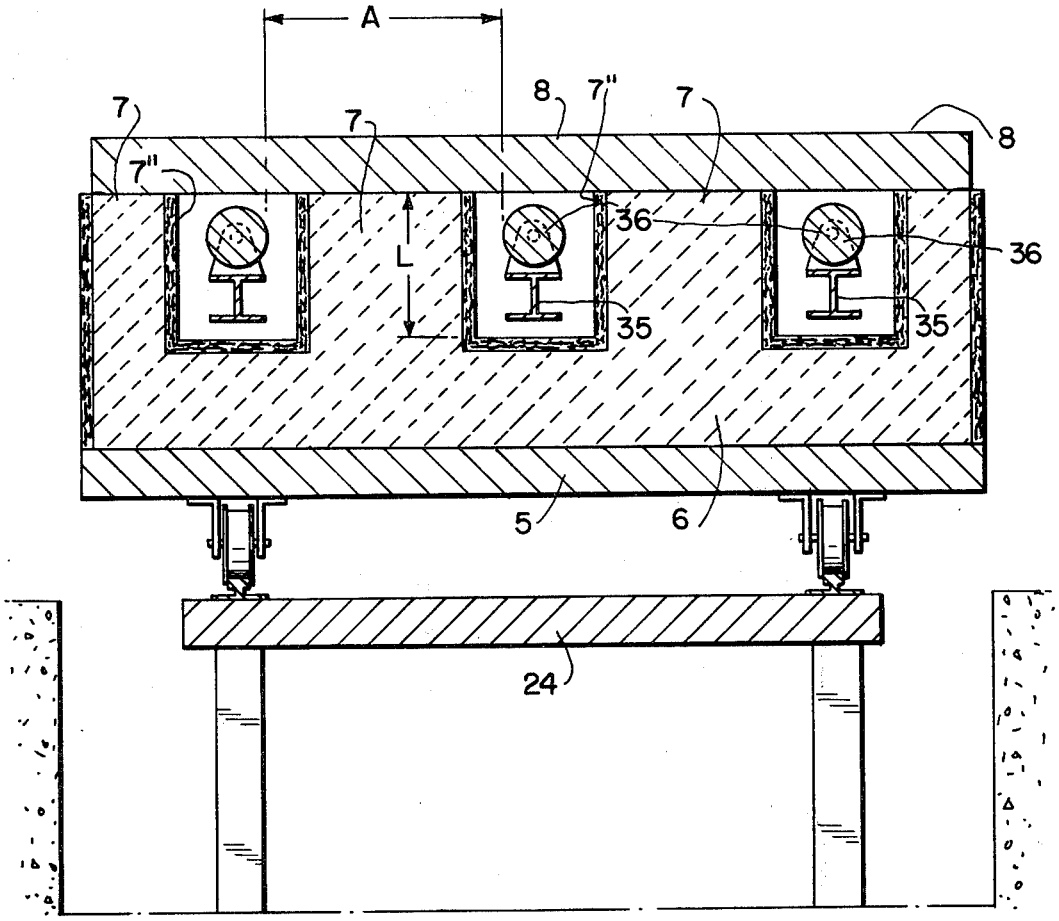
FIG. 7 is a schematic transverse section of the unloading installation just prior to unloading of a heated product.

With reference now to FIGS. 5 through 7 of the drawings, an embodiment of the invention including modified loading and unloading structure will be described.

In this embodiment, charging station 15 is replaced by a loading installation 38, and unloading structure 22 is replaced by a discharge installation 32. Each installation 32 and 38 includes a grate 34 supported by a stand 33. Each grate 34 is formed by a plurality of elongated finger-like projections 35 in a manner similar to the first embodiment. Each projection 35 however supports thereabove a transport roller 36 rotatable about a longitudinal axis extending in the direction of travel F of the carriages through the furnace chamber. Rollers 36 are supported in bearings 37 on respective projections 35 and may be driven, for example by means electric motors, for rotation about their rotational axes. The spacing A between adjacent projections 35 and rollers 36 is sufficiently large such that support members 7 may fit therebetween. The total height H of projections 35 and respective rollers 36 is less than the height L of the support members 7. Therefore, support members 7 of a carriage 5 positioned beneath a grate 34 will slightly extend above rollers 36, thus slightly raising a product 8 above the grate. The length of projections 35 and rollers 36 is approximately equal to the length of a carriage. It will be apparent that rotation of rollers 36 at installations 38 and 32 allow for loading of a product 8 to be heated onto grate 34 and unloading of a heated product from grate 34, respectively.

One use for the embodiment of FIGS. 5 through 7 is for a normalizing oven for boiler plates. In such an arrangement, loading installation 38 would be provided with a grate without rollers. The plates would be positioned on the grate according to a specific position plan. Subsequently, elevator 19 would lift a carriage 5, with the support members 7 thereof entering between projections 35, thus lifting a metal plate or plates from grate 34. The carriage 5 would then be passed through door 2 into the furnace chamber. A downstream-most carriage 5 with an annealed load of boiler plates would be pushed outwardly through door 3 at the discharging end of the furnace chamber, with the support members 7 of such carriage moving between projections 35 and rollers 36 of discharge installation 32. The carriage would then be lowered by means of elevator 24, with the result that the annealed boiler plates would come to rest on rollers 36. The rollers would then be driven, for example by an electric motor, so that the annealed boiler plates would be laterally discharged by the rollers 36. The discharge installation 32 would then immediately be ready for unloading of the next following carriage. Return of the unloaded carriages could be achieved in a manner similar to that described with regard to the first embodiment. Pushing of the loaded carriage into the furnace chamber may be achieved by any convenient manner. It will further be understood that the charging installation 38 could be provided with rollers 36 as shown in FIG. 5, thereby enabling lateral loading of products to be heated.

Although the present invention has been described and illustrated with respect to preferred features thereof, it is to be understood that various modifications and changes may be made without departing from the scope of the present invention.

What is claimed is:

1. A furnace for heating all sides of products such as slabs, billets, rough castings and the like, said furnace comprising:

a furnace chamber having a charging end and a discharging end;

support means for supporting products to be heated within said chamber, said support means comprising a plurality of carriages positioned throughout the length of said furnace chamber for sequential movement therethrough from said charging end thereof to said discharging end thereof, each said carriage including a support bench having extending upwardly therefrom support members for supporting a product to be heated, said support members extending longitudinally in the direction of movement of said carriages through said furnace chamber;

a charging station located adjacent said charging end of said furnace chamber for loading a product to be heated onto a said carriage and introducing the thus loaded carriage into said furnace chamber, thereby displacing loaded said carriages within said furnace chamber toward said discharging end and discharging a downstream-most said loaded carriage from said discharging end of said furnace chamber, said charging station including a grate formed of elongated finger-like projections extending in said direction, said projections being positioned to fit between adjacent said support members, each said projection having mounted thereabove a roller having a rotational axis extending in said direction, the distance between adjacent said rollers being at least equal to the distance between adjacent said support members;

unloading means, located adjacent said discharging end, for unloading a heated product from said carriage discharged from said discharging end;

a return chamber exterior of said furnace chamber and extending from adjacent said unloading means to said charging station to enable said carriage unloaded by said unloading means to be returned to said charging station; and heat insulation means within said return chamber for reducing heat loss from said unloaded carriage while said unloaded carriage is in said return chamber.

2. A furnace as claimed in claim 1, wherein the combined height of each said projection and the said roller thereabove is less than the height of said support members.

3. A furnace as claimed in claim 2, wherein said charging station further includes elevator means for lifting said unloaded carriage from said return chamber toward said grate, whereby a product to be heated which is supported on said rollers is lifted from said rollers by said support members.

4. A furnace as claimed in claim 2, wherein said rollers are motor driven to rotate about the axes thereof.

5. A furnace for heating all sides of products such as slabs, billets, rough castings and the like, said furnace comprising:

a furnace chamber having a charging end and a discharging end;

support means for supporting products to be heated within said chamber, said support means comprising a plurality of carriages positioned throughout the length of said furnace chamber for sequential movement therethrough from said charging end thereof to said discharging end thereof, each said carriage including a support bench having extending upwardly therefrom support members for supporting a product to be heated, said support members extending longitudinally in the direction of movement of said carriages through said furnace chamber;

a charging station located adjacent said charging end of said furnace chamber for loading a product to be heated onto a said carriage and introducing the thus loaded carriage into said furnace chamber, thereby displacing loaded said carriages within said furnace chamber toward said discharging end and discharging a downstream-most said loaded carriage from said discharging end of said furnace chamber;

unloading means, located adjacent said discharging end, for unloading a heated product from said carriage discharged from said discharging end, said unloading means comprising a grate formed of finger-like projections extending in said direction, said projections being positioned to fit between adjacent said support members of said carriage discharged from said discharging end of said furnace chamber, each said projection having mounted thereabove a roller having a rotational axis extending in said direction, the distance between adjacent said rollers being at least equal to the distance between adjacent said support members;

a return chamber exterior of said furnace chamber and extending from adjacent said unloading means to said charging station to enable said carriage unloaded by said unloading means to be returned to said charging station; and heat insulation means within said return chamber for reducing heat loss from said unloaded carriage while said unloaded carriage is in said return chamber.

6. A furnace as claimed in claim 5, wherein said rollers are motor driven to rotate about the axes thereof.

7. A furnace for heating all sides of products such as slabs, billets, rough castings and the like, said furnace comprising:

a furnace chamber having a charging end and a discharging end;

support means for supporting products to be heated within said chamber, said support means comprising a plurality of carriages positioned throughout the length of said furnace chamber for sequential movement therethrough from said charging end thereof to said discharging end thereof, each said carriage including a support bench having extending upwardly therefrom support members for supporting a product to be heated, said support members extending longitudinally in the direction of movement of said carriages through said furnace chamber, said support means defining a separate passage extending through a lower portion of said furnace chamber, said separate passage being positioned beneath and substantially thermally isolated from that portion of said furnace chamber through which pass the products to be heated;

openable furnace doors at said charging and discharging ends of said furnace chamber, said doors, when closed, maintaining opposite ends of said separate passage open to the exterior, such that when said doors close opposite ends of said portion of said furnace chamber through which pass the products to be heated, air from the exterior is circulated through said separate passage;

a charging station located adjacent said charging end of said furnace chamber for loading a product to be heated onto a said carriage and introducing the thus loaded carriage into said furnace chamber, thereby displacing loaded said carriages within said furnace chamber toward said discharging end and discharging a downstream-most said loaded carriage from said discharging end of said furnace chamber, said charging station including a grate formed of elongated finger-like projections extending in said direction, said projections being positioned to fit between adjacent said support members, the height of said projections being less than the height of said support members;

unloading means, located adjacent said discharging end, for unloading a heated product from said carriage discharged from said discharging end, said unloading means comprising a grate formed of finger-like projections extending in said direction, said projections being positioned to fit between adjacent said support members of said carriage discharged from said discharging end of said furnace chamber, said grate being vertically movable for thereby lifting from said discharged carriage the heated product thereon;

a return chamber exterior of said furnace chamber at a position beneath said separate passage, said return chamber extending from adjacent said unloading means to said charging station to enable said carriage unloaded by said unloading means to be returned to said charging station;

heat insulation means within said return chamber for reducing heat loss from said unloaded carriage while said unloaded carriage is in said return chamber, said heat insulation means comprising at least one heat insulation hood mounted within said return chamber to be vertically movable therein to a position to cover at least portions of said support members; and said charging station further including elevator means for lifting said unloaded carriage from said return chamber toward said grate, whereby a product to be heated and supported on said projections is lifted from said projections by said support members, and a push rod charger for advancing said loaded carriage into said furnace chamber, said push rod charger being supported in a protected bearing in one of said projections of said grate.

8. A furnace as claimed in claim 7, further comprising rails in said furnace chamber, and wherein said carriages are guided for movement through said furnace chamber by said rails.

9. A furnace as claimed in claim 8, wherein said return chamber has therein rails for guiding the movement of said unloaded carriage.

10. A furnace as claimed in claim 9, further comprising additional elevator means adjacent said unloading means for moving said unloaded carriage from said discharging end of said furnace chamber to said return chamber, said elevator means of said charging station and said additional elevator means including rail extensions positioned to align with said rails in said furnace and return chambers.

11. A furnace as claimed in claim 7, wherein said support benches and support members are formed of refractory fire-proof material.

12. A furnace as claimed in claim 11, wherein the chamber-facing surfaces of each said support bench and the respective said support members, except the contact surfaces of said support members to be in contact with the product to be heated, are covered with a heat resistant fiber mat material, said contact surfaces being free of said fiber mat material and adapted to directly contact the product to be heated.

13. A furnace as claimed in claim 7, wherein lateral walls of said furnace chamber include longitudinally extending channels, each said carriage extends across substantially the entire width of said furnace chamber, and said carriages have depending therefrom aprons contacting ledges of said channels.

14. A furnace as claimed in claim 13, wherein adjacent said support benches are in abutting contact in said direction.

15. A furnace as claimed in claim 7, wherein said heat insulation hood is heatable.

* * * * *